United States Patent [19]

Vogt

[11] 4,059,238

[45] Nov. 22, 1977

[54] MACHINE FOR WINDING CONTAINERS

[76] Inventor: Kurt Vogt, Beinwil am See, Switzerland

[21] Appl. No.: 612,506

[22] Filed: Sept. 11, 1975

Related U.S. Application Data

[63] Continuation-in-part of Ser. No. 505,872, Sept. 13, 1974, abandoned, which is a continuation-in-part of Ser. No. 288,238, Sept. 11, 1972, abandoned.

[30] Foreign Application Priority Data

Mar. 13, 1972 Switzerland ..... 3617/72

[51] Int. Cl.[2] ..... B21F 17/00

[52] U.S. Cl. ..... 242/7.21

[58] Field of Search ..... 242/7.21, 7.22, 7.23, 242/7.01

[56] References Cited

U.S. PATENT DOCUMENTS

| | | | |
|---|---|---|---|
| 2,364,696 | 12/1944 | Crom | 242/7.21 X |
| 2,370,780 | 3/1945 | Crom | 242/7.21 X |
| 2,372,060 | 3/1945 | Crom | 242/7.21 X |
| 2,785,866 | 3/1957 | Vogt | 242/7.21 |
| 2,797,878 | 7/1957 | Crom, Jr. | 242/7.21 |
| 3,452,940 | 7/1969 | Brandestine | 242/7.21 X |
| 3,572,596 | 3/1971 | Dykmans | 242/7.21 |
| 3,666,189 | 5/1972 | Dykmans | 242/7.21 |
| 3,666,190 | 5/1972 | Dykmans | 242/7.21 |
| 3,687,380 | 8/1972 | Magers et al. | 242/7.21 |
| 3,773,270 | 11/1973 | Brandestine | 242/7.21 |

*Primary Examiner*—Billy S. Taylor

*Attorney, Agent, or Firm*—Ladas, Parry, Von Gehr, Goldsmith & Deschamps

[57] ABSTRACT

A machine for winding a body, such as a container, tubular member or the like with a tension cable which is tensioned with an adjustable force, comprises a machine carriage movable at a predertermined speed about the body to be wound. The carriage has a drive shaft, a main drive motor for driving the drive shaft, a clamping wheel mounted for rotation on the carriage for tensioning the cable, and a mechanism for maintaining substantially constant the force in the cable. This mechanism incorporates a brake which is driven by the clamping wheel and is mounted to pivot about a fixed pivot axis upon being so driven, and an auxiliary motor for auxiliary drive of the carriage. The brake transmits energy taken-up during braking to the auxiliary motor. A spring resists pivotal movement of the brake about the pivot axis, so that the brake assumes a pivotal position about the shaft dependent upon the rotational moment transmitted to the brake by the clamping wheel. The energy transmitted by the brake to the auxiliary motor is regulated as a function of the pivotal position of the brake about the pivot axis so as to change the relationship of the speed of the machine carriage to the rotational speed of the clamping wheel in such a manner that the force in the tension cable strives to approach a desired value.

15 Claims, 2 Drawing Figures

MACHINE FOR WINDING CONTAINERS

Figures 1, 2:
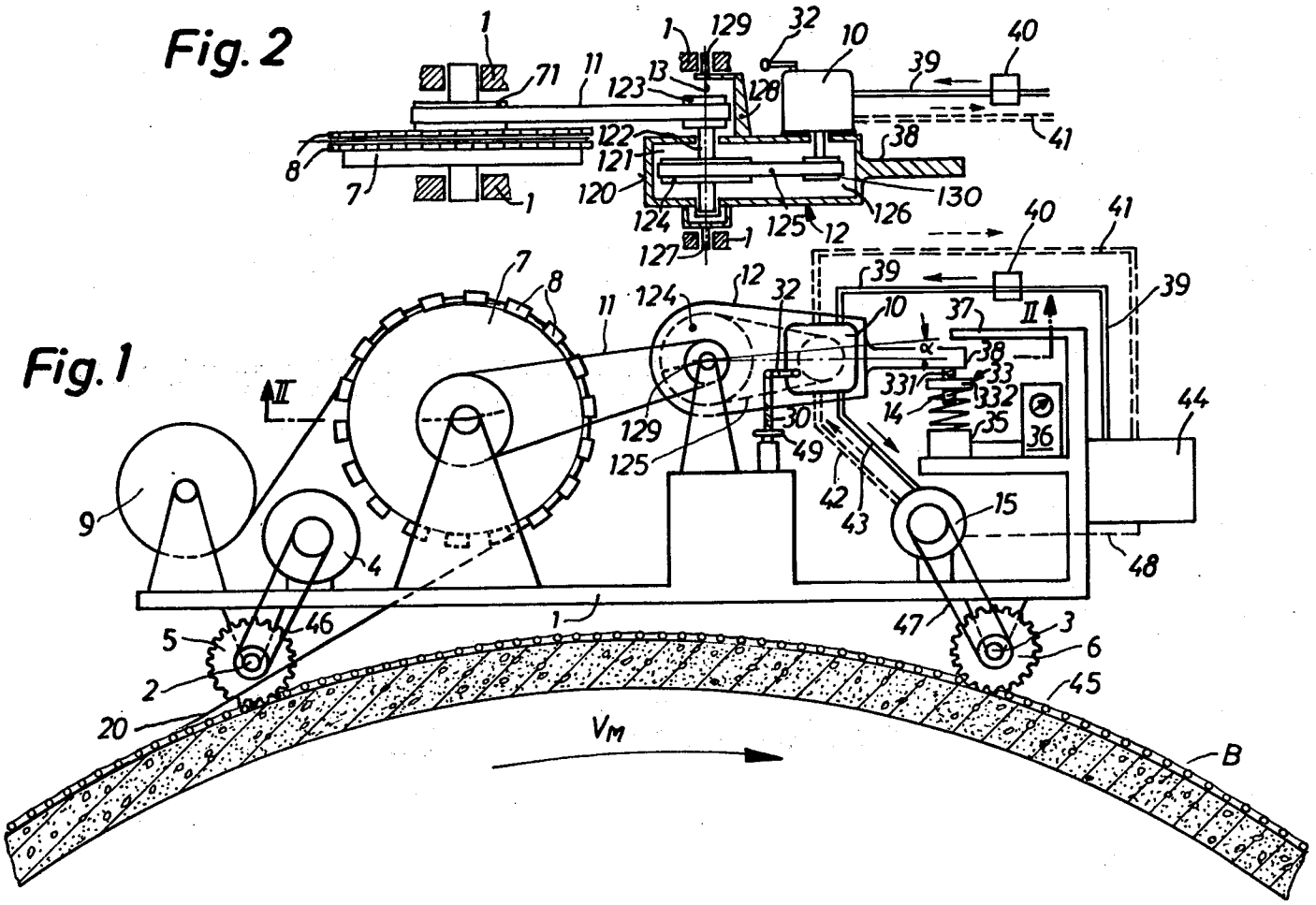

This is a continuation-in-part of Application Ser. No. 505,872 filed Sept. 13, 1974, and now abandoned which is itself a continuation of application Ser. No. 288,238 filed Sept. 11, 1972 and now abandoned.

This invention relates to a machine for winding containers, tubes and the like with a tension cable stressed or tensioned with a predetermined force, the machine comprising a carriage or frame which can be moved at a predetermined speed about the body to be wound and has at least one drive shaft driven by a main driving motor, a clamping wheel mounted on the frame for retaining the tension cable and a mechanism for regulating the tension under which the tension cable is maintained.

Machines of this type are used, for example, for winding concrete containers or vessels for nuclear reactors. The machine usually runs in horizontal rails mounted on the containers, which themselves stand in upright position. To these rails are also secured chains or toothed racks, and toothed wheels connected to the drive shaft mesh with the chains or racks. The frame can be vertically adjusted to make it possible to lay the turns of the tension cable side-by-side.

One of the problems posed by those machines consists in regulating the tension in the tension cable to maintain as far as possible a constant preselected value.

According to the present invention there is provided a machine for winding a body such as containers, tubular members and the like with a tension cable which is tensioned with an adjustable force, comprising a machine carriage movable at a predetermined speed about the body to be wound, said carriage having at least one drive shaft, a main drive motor for driving said carriage, a clamping wheel mounted for rotation at said carrier for tensioning the cable mechanism for maintaining substantially constant the force at the cable, said mechanism incorporating braking means driven by said clamping wheel, at least one auxiliary motor for driving said drive shaft, said braking means transmitting the energy taken-up during braking to said at least one auxiliary motor for said drive shaft, means for pivotably mounting said braking means against the action of a spring about a fixed pivot shaft as a function of the rotational moment transmitted to said braking means by said clamping wheel, and control means for regulating as a function of the pivotal position of the braking means the energy transmitted by said braking means so as to change the relationship of the speed of the machine carriage to the rotational speed of the clamping wheel in such a manner that the force in the tension cable strives to approach a desired value.

The present invention may used to provide a winding machine in which the tension in the tension cable can be both regulated and measured in a specially economical and simple manner.

For a better understanding of the invention, and to show how the same may be carried into effect, reference will now be made, by way of example, to the accompanying drawing in which:

FIG. 1 shows diagrammatically a machine embodying the present embodiment invention disposed on the exterior of a cylindrical container which is to be wound with cable and which stands in upright position, and FIG. 2 shows a section taken on the line II — II shown in FIG. 1.

The illustrated winding machine comprises a carriage 1 on which the different components of the winding machine are mounted. The carriage 1 has two drive shafts 2 and 3 of which the shaft 2 shown at the left is driven at a preselectable constant speed by a main drive motor 4, for example an electric motor, via a chain 46. The shafts 2 and 3 support respective pairs of sprocket wheels 5 and 6 which mesh with the links of a pair of chains 45 which extend around the container B. In FIG. 1 only the upper sprocket wheels 5 and 6 and the upper chain 45 can be seen.

On the machine frame 1 is disposed a so-called clamping wheel 7. About the periphery of the clamping wheel 7 are disposed clamping jaws 8 which fixedly clamp a cable or wire 20 which is paid off a spool 9 likewise disposed on the carriage 1 or on a separate carriage to transmit the required force from the clamping wheel to the tension cable and thereby apply it also to the wall of the container. The clamping wheel 7, which is described and claimed in my Application Serial No. 575,557 filed May 8, 1975, must be braked in order to produce tension in the cable 20. In the illustrated machine this is done by means of a brake consisting of a commercial hydraulic pump 10 of adjustable discharge. The rotor of the pump 10 is driven by the clamping wheel 7 via a chain 11 and a gearing device 12, and its housing is supported by the housing of the gearing device.

The gearing device 12 includes a gearbox 120 of elongated shape, there being mounted in one of the ends 121 (FIG. 2) thereof a shaft 122 the upper end of which as seen in FIG. 2 projects from the gearbox 120 and has a sprocket wheel 123 fitted tightly thereon. The sprocket wheel 123 is connected by means of the chain 11 (only diagrammatically shown in the drawing) to a sprocket wheel 71 that likewise fits tightly on the shaft of the clamping wheel 7. In the interior of the gearbox is a further sprocket wheel 124 fitted on the shaft 122. The sprocket wheel 124 is connected to a further sprocket wheel 130 positioned in the other end of the gearbox 120 by means of a chain 125. The sprocket wheel 130 is fitted upon the shaft of the pump 10.

The underside, as seen in FIG. 2, of the gearbox 120 has a pivot pin 127 which is rotatably mounted in the carriage 1 and is coaxial with the gear shaft 122. The upper side of the gearbox 120 carries a bearing bracket 128 that is likewise supported in the carriage 1 by means of a second pivot pin 129. The second pivot pin 129 is also coaxial with the gear shaft 122 so that the gearbox 120 is rotatable about an axis 13 that extends through the pivot pins 127 and 129 and the driving shaft 122 of the gearing device.

The front wall of that end 126 of the gearbox 120 which supports the pump 10 is provided with an arm 38 the free end which lies between a stationary stud 37 of the carriage 1 and an adjustable prestressing apparatus 33. The prestressing apparatus 33 includes a spindle 331 and a nut 332 and is supported by a spring 14 mounted on a pressure cell 35 secured to the carriage 1, the fluid pressure of the pressure cell 35 being transmitted to an indicating and recording instrument 36. The spindle 331 and the nut 332 serve to prestress the spring 14.

The pump 10 is a commercial hydraulic adjustable pump, the specific discharge of which, that is, its capacity per revolution, can be adjusted continuously by means of a choke arm 32. The pump 10 sucks in oil from a tank 44 through a filter 40 and a hose pipe 39 and feeds it to the adjustable pump 10. A hose pipe 41 returns oil from the pump 10 to the oil tank 44.

The adjustable pump 10 is connected on the pressure side by means of a hose pipe 43 to an hydraulic motor 15 having a constant specific capacity of absorption, that is, a constant capacity of absorption per revolution. Used oil from the hydraulic motor 15 flows back through a hose pipe 42. Leakage oil flows through a pipe 48 directly back to the oil tank 44. The hydraulic motor 15 is connected by a chain 47 to drive the sprocket wheel 6.

The adjustable pump 10 has a choke arm 32 whereby the specific discharge of the pump can be adjusted. Rotation of the arm 32 in the clockwise direction, as seen in FIG. 1, relative to the pump housing is effective to decrease the specific discharge, whereas rotation of the arm in the counterclockwise direction is effective to increase the specific discharge. The end of the choke arm 32 is connected by means of a conventional pivotal connection to a regulating spindle 30 threaded into a handwheel 49 mounted on the carriage 1. By means of the handwheel 49 the upper end of the spindle 30 can be raised or lowered to decrease or increase the specific discharge of the pump for a given angular position of the pump about the axis 13. Also, for a given position of the spindle 30 rotation of the pump about the axis 13 in the clockwise or counterclockwise direction as seen in FIG. 1 decreases or increases the specific discharge of the pump.

Prior to commencement of the tensioning operation no tension is exerted on the tension cable 20. The free end of the arm 38 abuts on the stationary stud 37 because the spring 14 presses upwardly on the arm via the prestressing apparatus 33. Because the arm 38 is in its uppermost position, the pump 10 is also in its uppermost position and therefore the arm 32 is in its extreme counterclockwise position and the pump has its maximum specific discharge for the particular setting of the handwheel 49.

As the winding machine starts to advance, the carriage 1 driven by the engine 4 moves in the direction of the arrow Vm in FIG. 1. The clamping wheel 7 is coupled with the adjustable pump 10 by the chains 11 and 125. A slight movement of the clamping wheel 7 which is produced by the cable 20 anchored on the container drives the pump 10 and produces the discharge of an amount of oil, to the motor 15, which is much larger than the amount of oil that the motor 15 can consume at the initially low speed of the carriage 1. This results in a build-up of pressure in the pipe 43 that effectively resists rotation of the rotor of the pump 10, and thereby also resists rotation of the clamping wheel 7. Therefore, an increasing force is produced in cable 20.

Since the rotor of the adjustable pump 10 cannot rotate quickly enough due to the face that the oil absorption of the motor is too small, naturally the gear shaft 122, with the sprocket wheels 123 and 124 mounted thereon, is also unable to rotate quickly enough. The chain 11 upon which a constantly increasing traction is exerted by the clamping wheel 7 acts on the upper gear wheel 123, and since the shaft 122 is braked by the pump 10, the whole gearbox 120 begins to rotate clockwise (as seen in FIG. 1) about the common axis 13 of the pivot pins 127 and 129 through an angle $\alpha$ in response to the action of the spring 14. The clockwise rotation of the gearbox 120 also results in the choke arm 32 of the adjustable pump 10 being rotated clockwise relative to the pump, thereby to reduce the rate at which oil is delivered by the adjustable pump 10 to the motor 15.

The gearbox 120 will now rotate clockwise about the common axis of the pivots 127 and 129, reducing the discharge capacity of the pump, until the rate of which oil is supplied by the adjustable pump 10 is practically equal to the rate at which oil is consumed by the motor 15. This selfregulating mechanism establishes a steady state and a constant braking force is transmitted to the clamping wheel 7.

The magnitude of the braking force can be adjusted prior to or during the operation of the winding machine by means of the prestressing apparatus 33 for the spring 14, and/or by means of the spindle 30 and the handwheel 49.

Let us assume now that the tension in the tension cable 20 drops for some reason. Then the peripheral force applied by the cable to the clamping wheel 7 also falls, as does the torque transmitted to the gearing device 12 with the pump 10. Thus, the spring 14 will urge the arm 38 towards the stud 37 causing the gearbox 12 and the pump 10 to rotate in the counterclockwise direction as seen in FIG. 1. As the pump 10 rotates, it causes the choke arm 32 of the adjustable pump to effect a slight counterclockwise rotation (as seen in FIG. 1) thereby adjusting the pump to a greater specific discharge. The resulting greater rate of supply oil cannot be absorbed by the constant capacity motor 15 since its speed of rotation, and therefore its rate of absorption, depends on that of the main motor 4 to which it is frictionally connected by the members 47, 6, 45, 5, 46. Therefore a pressure rise of the oil between the pump 10 and the motor 15 occurs and this gives rise to an increase in the torque required to drive the pump. However, the clamping wheel 7 can only apply a greater torque to the pump by increasing the peripheral force derived from the tension in the cable, and the tension can only increase if the speed of the clamping wheel 7 and therewith that of the pump 10 diminish somewhat. The result of increasing the specific discharge of the pump and reducing its speed is that the pump again achieves a discharge rate that can be absorbed by the constant capacity motor 15.

Assuming the other case that the tension in the cable 20 for some reason increases above the desired value, then the regulating operation is logically effected in opposite direction. It will thus be seen that the clamping wheel 7, the pump 10 and the motor 15 are connected in a negative feedback loop whereby the torque of the clamping wheel is automatically adjusted to maintain the tension in the cable at the desired value. The spring 14 is chosen to be quite long in order that just a slight change of the load will produce a relatively large deflection of the spring. The regulation thus becomes more precise and accurate.

By means of this simple and reliable regulating apparatus, the preselected tension in the cable is kept quite precisely constant, is accurately detected by the pressure cell 35 and indicated on the measuring instrument. Another advantage of this winding machine in comparison to other winding machines is that the cable 20 is bent only once over the relatively large clamping wheel 7 and this not even about the whole circumference of the clamping wheel 7, which is very desirable with regard to the subsequent relaxation of the cable 20.

Still another advantage of the instant winding machine is due to the fact that the energy required to brake the clamping wheel 7 is not uselessly destroyed; a portion of that energy is returned to the sprocket wheel 6 via the hydraulic motor 15, which represents a substantial economic advantage.

Instead of the hydraulic pump 10, it would be possible to use an electric generator that transmits the energy absorbed by the clamping wheel 7 to an auxiliary electric motor that assists the main driving motor.

It is also possible to provide on both of the axles 2 and 3 respective auxiliary motors to which the energy of the clamping wheel is distributed.

I claim:

1. A machine for winding a body such as containers, tubular members and the like with a tension cable which is tensioned with an adjustable force, comprising a machine carriage movable at a predetermined speed about the body to be wound, said carriage having at least one drive shaft, a main drive motor for driving said drive shaft, a clamping wheel mounted for rotation on said carriage for tensioning the cable, and a mechanism for maintaining substantially constant the force in the cable, said mechanism incorporating braking means driven by said clamping wheel and mounted to pivot in one direction about a fixed pivot axis upon being driven by said clamping wheel, at least one auxiliary motor for auxiliary drive of said carriage, said braking means being connected to said at least one auxiliary motor to transmit the energy taken-up during braking from said braking means to said at least one auxiliary motor, a spring resisting pivotal movement of said braking means in said one direction about said fixed pivot axis whereby said braking means assume a pivotal position about the pivot axis dependent on the rotational moment transmitted to said braking means by said clamping wheel, and control means for regulating as a function of the pivotal position of the braking means about the pivot axis the energy transmitted from said braking means to said at least one auxiliary motor so as to change the relationship of the speed of the machine carriage to the rotational speed of the clamping wheel in such a manner that the force in the tension cable strives to approach a desired value.

2. A machine as claimed in claim 1, wherein said braking means comprises an hydraulic pump and wherein said at least one auxiliary motor comprises an hydraulic motor.

3. A machine as claimed in claim 1, wherein an additional drive shaft is provided, and wherein one such auxiliary motor driven by said braking means is provided for each drive shaft.

4. A machine as claimed in claim 1, wherein said control means alters the energy transmitted by the braking means as a function of the pivotal position of the braking means in such a manner that with increased pivoting of the braking means the energy is reduced and vice versa.

5. A machine as claimed in claim 1, further including means for adjusting the resisting force of said spring in order to adjust the tension force at the cable.

6. A machine as claimed in claim 4, wherein said braking means possesses a control rod, and said control means regulates said control rod in order to adjust the tension force at the cable.

7. A machine as claimed in claim 1, further including a measuring device against which is supported the pivotably mounted braking means in order to measure the magnitude of the force at the tension cable.

8. A machine as claimed in claim 7, wherein said measuring device comprises a pressure cell which is operatively associated with a pressure measuring instrument.

9. A machine as claimed in claim 8, wherein said pressure measuring instrument further defines a recording instrument.

10. A winding machine for winding a body such as a container, a tubular member or the like with a cable stressed under a preselected tension, comprising:

a machine carriage movable about the body to be wound;

a main drive motor mounted on the carriage for driving the carriage about the body;

a clamping wheel mounted on the carriage for retaining the cable;

dynamic braking means;

pivot means supporting the braking means so that said braking means are rotatable with respect to the carriage about an axis fixed with respect to the carriage;

connection means connecting the braking means drivingly to the clamping wheel so that rotation of the clamping wheel in the direction to feed cable onto the body tends to cause the braking means to rotate about said axis in one sense;

resilient means opposing rotation of the braking means about said axis in said one sense;

control means to regulate the energy absorbed by the braking means according to the angular position of the braking means about said axis; and, an auxiliary drive motor coupled to the braking means to employ energy absorbed thereby to drive the carriage about the body, the clamping wheel, the braking means and the auxiliary drive motor being connected in a negative feedback loop whereby the torque of the clamping wheel is automatically adjusted to maintain the tension in the cable at a preselected value.

11. A machine as claimed in claim 10, wherein the braking means include a gearing device and a braking device, the gearing device including a driving wheel coupled to the braking device and connected by said connection means to receive drive from the clamping wheel, the axis of rotation of the driving wheel coinciding with the axis of rotation of the braking means with respect to the carriage.

12. A machine as claimed in claim 11, comprising a stationary stud and a prestressing apparatus including said spring, and wherein the braking device is an hydraulic pump of adjustable specific discharge and the control means include an arm directed radially away from the common axis of rotation of the braking means and said driving wheel between said stationary stud and said prestressing apparatus, and the control means also include a regulating device comprising a choke arm, which is rotatable with respect to the hydraulic pump to adjust the specific discharge thereof, and a regulating spindle pivotally connected to said choke arm and adjustably mounted on the carriage so that rotation of the braking means with respect to the carriage brings about rotation of the choke arm with respect to the hydraulic pump.

13. A machine as claimed in claim 12, wherein the auxiliary driving motor is an hydraulic motor connected to be driven by hydraulic fluid supplied from said pump.

14. A machine as claimed in claim 10, wherein the pivotally mounted braking means interact with a measuring device to measure the magnitude of the tension in said cable.

15. A machine as claimed in claim 14, wherein said measuring device comprises a pressure cell connected to a pressure measuring and recording instrument.

* * * * *